US006843300B2

(12) United States Patent
Mullet et al.

(10) Patent No.: US 6,843,300 B2
(45) Date of Patent: Jan. 18, 2005

(54) SECTIONAL DOOR WITH SELF-ALIGNING HINGES AND METHOD OF ASSEMBLY

(75) Inventors: Willis J. Mullet, Gulf Breeze, FL (US); Albert W. Mitchell, Pensacola, FL (US); Thomas B. Bennett, III, Wooster, OH (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/394,635

(22) Filed: Mar. 21, 2003

(65) Prior Publication Data

US 2004/0182529 A1 Sep. 23, 2004

(51) Int. Cl.[7] ..... E06B 3/48

(52) U.S. Cl. ..... 160/201; 160/229.1; 160/232; 16/266

(58) Field of Search ..... 160/201, 229.1, 160/232, 236, 209, 40, 199, 206, 223; 16/266

(56) References Cited

U.S. PATENT DOCUMENTS

| | | | | | |
|---|---|---|---|---|---|
| 4,205,713 | A | * | 6/1980 | Galbreath | 160/201 |
| RE31,086 | E | | 11/1982 | Johnson, Jr. et al. | 220/337 |
| 4,438,597 | A | * | 3/1984 | Maggart | 49/501 |
| 4,799,291 | A | | 1/1989 | Ankum et al. | 16/259 |
| 4,817,842 | A | * | 4/1989 | Wilson, III | 226/74 |
| 5,235,724 | A | | 8/1993 | Perrin et al. | 16/97 |
| 5,297,314 | A | * | 3/1994 | Bender et al. | 16/270 |
| 5,448,799 | A | * | 9/1995 | Stein, Jr. | 16/225 |
| 5,664,288 | A | * | 9/1997 | Lautenschlager et al. | 16/249 |
| 5,713,105 | A | * | 2/1998 | Toomey | 16/245 |
| 5,782,283 | A | | 7/1998 | Kendall | 160/229.1 |
| 5,864,922 | A | | 2/1999 | Kraft | 16/266 |
| 5,921,307 | A | | 7/1999 | Ford et al. | 160/229.1 |
| 6,006,817 | A | | 12/1999 | Stone et al. | 160/201 |
| 6,059,350 | A | * | 5/2000 | Kooiker | 296/100.09 |
| 6,112,799 | A | * | 9/2000 | Mullet et al. | 160/201 |
| 6,129,132 | A | * | 10/2000 | Denoual et al. | 160/235 |
| 6,170,900 | B1 | * | 1/2001 | Kooiker | 296/107.09 |
| 6,257,304 | B1 | * | 7/2001 | Jacobs et al. | 160/206 |
| 6,325,962 | B1 | | 12/2001 | Kmiecik et al. | 264/523 |
| 6,363,993 | B1 | * | 4/2002 | Aquilina | 160/229.1 |
| 6,560,821 | B2 | * | 5/2003 | Miller et al. | 16/252 |
| 6,643,895 | B1 | * | 11/2003 | Domenig et al. | 16/238 |
| 2004/0007334 | A1 | * | 1/2004 | Lewis, Jr. | 160/201 |

* cited by examiner

*Primary Examiner*—Bruce A. Lev
(74) *Attorney, Agent, or Firm*—Renner, Kenner, Greive, Bobak, Taylor & Weber

(57) ABSTRACT

A door system comprising, a plurality of sections pivotally joined to each other by a hinge assembly, the hinge assembly being pivotally supported on one of the sections and having a leg that extends from the one of the sections to an adjacent section to attach thereto, a stop assembly including a stop member extending forwardly from the leg toward a stop receiver carried on the one of the sections, whereby interaction of the stop member and the stop receiver ensure alignment of the sections.

30 Claims, 9 Drawing Sheets

SECTIONAL DOOR WITH SELF-ALIGNING HINGES AND METHOD OF ASSEMBLY

TECHNICAL FIELD

In general, the present invention relates to an upwardly acting sectional door. More particularly, the present invention relates to a door system having a hinge that permits self-adjusting movement of adjacent sections of the door. More specifically, the present invention relates to a door system having a hinge providing lateral movement of adjacent sections during articulation and vertical spacing in the closed planar position.

BACKGROUND ART

Most hinges used on sectional garage doors are three-piece hinge assemblies that consist of two leaves and a pivot pin. These components of the hinge assembly can be made of metallic or non-metallic materials. The pivot hinge can be a tubular or solid shaft that is threaded through the two leaves and staked, flared, or bradded into place. The leaves are designed to interlace each other such that there is little or no movement along the axis of the pivot pin. Alignment on these hinges is critical in that they must be aligned both horizontally and vertically to ensure proper movement of the hinge through its operating range without binding.

To provide for rotation between components, a variety of hinge constructions have been employed in the prior art. One construction utilizes a "living hinge" which includes a portion of plastic material connecting the various components. Living hinges tend to experience fatigue failure when used repeatedly or when used over a wide pivot range.

Another hinge construction includes pins and sockets formed directly within the parts to be joined. In one form a blow-molded container having has an integrally formed pin and socket forming a journal. The socket is formed from a flexible wall portion that extends beyond the main body of a lid. The socket, which is generally centered between the pins, flexes over the pins when the lid and base are brought together. While this construction enables the fabrication of an assembly having an integrally blow-molded hinge, the assembly has several disadvantages. The socket is made to have a spacing that lies at the midpoint of the pins when the base and lid are assembled. This allows the lid to slide transversely along the pins. Since the hinge is not self centering, this transverse movement may result in a misalignment that impairs the ability to open or close the members. The movement may also permit unwanted "play" between the members.

In another design having integrally formed blow molded hinge components, the components are made without additional fasteners, pins or sockets. The parts are made from a rigid plastic material that need not flex to be assembled. This enables the repeatability needed for high speed manufacturing operations and also reduces the possibility of inadvertently damaging the hinge by over flexing one of the components.

Turning to the upwardly acting door art, hinges are widely used in "sectional door" designs. These door designs incorporate a number of pivotally joined sections that may be successively raised or lowered within a door opening.

Sectional doors, such as multi-panel garage doors, have presented a pinching hazard at the juncture between adjacent panels as the door closes and the panels shift to an aligned vertical position. Prior art attempts to solve this problem have met with only limited success, sometimes presenting mechanical complexity or uneconomical designs. For example, one attempt at addressing the aforementioned problem includes a plurality of adjacent door panels, a hinge pin received in respective registered hinge pin holes defined in a bracket and brace. The adjacent panels present mated, arcuate edge walls. The bracket and brace are configured to position the hinge pin adjacent the one panel and spaced from the juncture so that the gap between the edge walls closes gradually and so that the edge walls slide by one another during movement from the pivoted position to the aligned position.

Another pinch-proof garage door design for protecting human fingers from being pinched includes a plurality of horizontally aligned garage door panels having a top male portion and a bottom female portion. Top male and bottom female portions of adjacent garage door panels cooperate with each other in such a manner so as to minimize a gap therebetween, thereby protecting human fingers from being pinched by both the inside and the outside of the garage door. Each garage door panel is securely fastened to a structural member, which supports the weight of the panel. Adjacent structural members are vertically aligned with one another and are coupled together by a hinge pin and hinge leaf. Each structural member cooperates with an adjacent hinge leaf so as to prevent human fingers from being pinched by the inside of the garage door.

Still another design features a hinge assembly that affords very simple and efficient installation of the hinge during the assembly and installation of the door while still minimizing and, in fact, reducing the number of component parts relative to other known hinge designs. This design includes a generally U-shaped beam or stile that extends between the upper and lower edges of the back face of each panel. Proximate an upper end of the stile, is a keyhole slot extending through or into the stile. A first lower portion of the hinge also includes a similarly configured keyhole slot. A pivot pin, which includes a protruding key, is inserted through the keyhole slots in the hinge and the stile when the keyhole slots are aligned. Alignment of the keyhole slots requires positioning an upper portion of the hinge away from the stile on the adjacent panel to which the hinge will eventually be connected. After the pivot pin is inserted through the keyhole slots, the hinge is pivoted so that the upper portion is then bolted or otherwise connected to the stile on the adjacent panel thereby completing the assembly of the hinge to the adjacent panels. Because the keyhole slots are out of phase when the hinge is finally connected to the panels, the pin cannot be removed. As a result, the assembly method of the hinge according to this invention does not require a separate fastener for the pivot pin thereby simplifying the installation procedure and minimizing inventory and tracking requirements for the component parts of this invention. Advantageously, the pivot pin and the resulting pivot axis of the hinge is positioned on the stile inwardly from the back face of the panels and between the front and back faces thereof to enhance the pinch-resistant aspect of this design while minimizing material requirements. Specifically, the pivot axis is approximately coincident with the center of curvature of the lower edge of the adjacent panel. The cross-sectional configuration of the concave lower edge of the adjacent panel is non-circular with several polygonal sections or linear segments. The focus of perpendiculars to the polygonal sections at the respective midpoints of the faces of the polygon is at a spot at or near the pivot axis. Preferably, the center of curvature of the polygonal areas defining the concaved lower edge is generally concentric with the pivot axis of the hinge and substantially spaced from the back face of the panel toward the front face of the panels. This hinge design aids in the making the door pinch resistant.

As can be seen from the above described designs, the prior art discloses many different hinge designs that attach adjacent sections or panels together and provide a pivot point for the sections. Most of these prior art hinges are modular assemblies that have little or no movement along the axis of the pivot so care must be taken during installation of the hinge to precisely align the hinges between the adjacent sections so that all of the pivots are on the same axis or binding will occur.

DISCLOSURE OF THE INVENTION

Therefore, an object of the present invention is to provide an upwardly acting sectional door having hinges that permit relative axial movement of adjacent sections. Another object of the present invention is to provide such a sectional door having hinges which permit a controlled extent of relative transverse movement of the adjacent sections through its range of articulation to prevent binding while accurately aligning adjacent sections in the planar closed position, a further object of the invention is to provide such a sectional door having a section spacing assembly to assure proper vertical separation of adjacent panels in the closed, planar position.

Another object of the present invention is to provide a sectional door having a primary centering assembly including a tab mounted on the hinges for selectively engaging a tab receiver mounted on the stiles for limiting axial movement of and aligning adjacent sections. Yet a further object of the present invention is to provide such a sectional door having an auxiliary or alternative centering device for progressively restricting lateral relative movement between adjacent sections as the door approaches the closed vertical position. Another object of the invention is to provide such a sectional door wherein the auxiliary or alternative center device has one or more gussets on the hinge leafs which engage gusset receivers on the stiles.

A further object of the invention is to provide a sectional door hinge configuration having a single hinge leaf with the pivot pins formed integrally therein to thereby minimize the number of parts required. A still further object of the invention is to provide such a hinge configuration wherein the stile sets alignment of the hinge and may be employed to prevent excessive relative movement between adjacent sections by constraining the hinge leaf within the interrelated stile. Yet another object of the invention is to provide such a hinge configuration in which the stile is configured to permit insertion of a hinge pin formed in the single hinge leaf and has integrally formed bearing members supporting pivot portions of the pivot pins.

In view of at least one of the foregoing objects, the present invention generally provides a door system comprising, a plurality of sections pivotally joined to each other by a hinge assembly, said hinge assembly being pivotally supported on one of said sections and having a leg that extends from said one of said sections to an adjacent section to attach thereto, a centering assembly including a tab member extending forwardly from said leg toward a stop receiver carried on said one of said sections, whereby interaction of said tab member and said tab receiver ensure alignment of said sections.

The present invention further provides a door system comprising: a plurality of sections pivotally joined by a hinge assembly; said hinge assembly being rotatably supported on one of said sections and attached to the other of said sections; said hinge being rotatable on an axis; alignment means carried on said hinge assembly urging said sections along said axis into alignment with each other during a selected portion of an operating range of said door, whereby said sections are movable relative to each other along said axis during the unselected portions of said operating range.

BEST MODE FOR CARRYING OUT THE INVENTION

Figure 1:
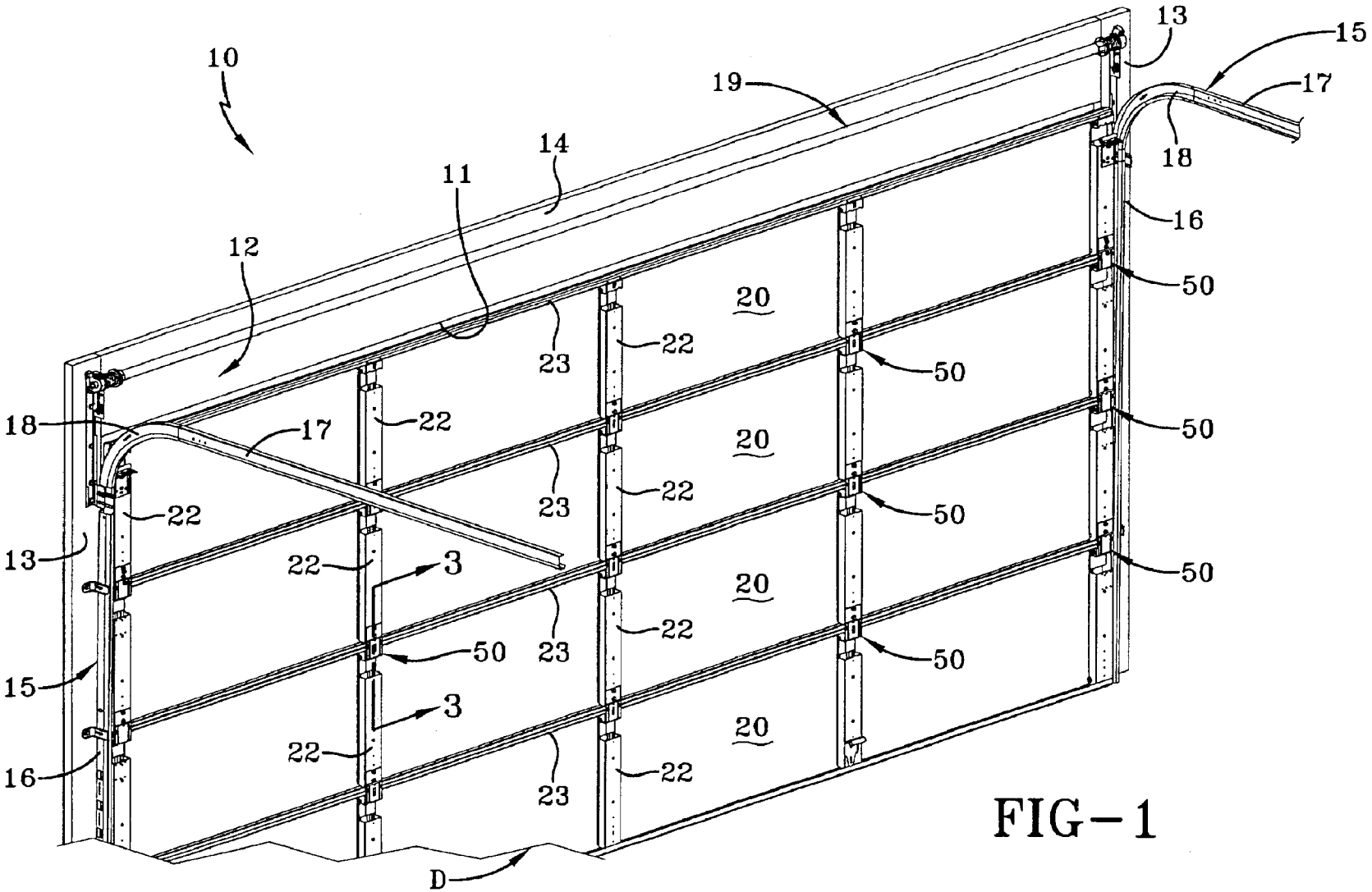
FIG. 1 is a rear perspective view of a door system according to the concepts of the present invention.

A door system according to the concepts of the present invention is generally indicated by numeral 10 in FIG. 1 of the drawings. Door system 10 includes a door, generally indicated at D, located within an opening 11 defined by a frame 12. Frame 12 includes a pair of spaced, vertical jambs 13 interconnected by a header 14 at their vertical upper extremity. Tracks, generally indicated by the numeral 15, are supported on frame 12 and guide the door D from a generally vertical closed position (FIG. 1) to a generally horizontal open position (not shown). To that end, each track 15 includes an upstanding vertical portion 16 supported on a jamb 13 and a generally horizontal portion 17 connected to the upstanding vertical portion 16 by an arcuate transition portion 18. To facilitate moving the door along the tracks 15, a counterbalance system, generally indicated by the numeral 19, may be employed and attached to the header 14. Since such counterbalance systems 19 are commonly used throughout the art, only a general reference will be made to the counterbalance system 19, it being understood that any number of existing counterbalance systems could be used in the practice of the concepts of the present invention.

The door D includes a plurality of pivotally joined sections, generally indicated by the numeral 20, that may include a panel 21 with one or more vertically extending stiles 22 and horizontally extending rails 23. As depicted in the embodiment shown in the drawings, the rails 23 may be integrally formed with the panel 21 and take the form of upper and lower flanges 24, 25 that extend rearwardly from the panel 21. Flanges 24, 25 are contoured to interact with each other as adjacent sections 20A, 20B pivot relative to each other during operation of the door D. Flanges 24, 25 may, for example, be contoured to make the door "pinch resistant." In particular, the contours of flanges 24, 25 are such that, as the sections 20A, 20B pivot relative to each other, the contours of flanges 24, 25 prevent the opening of any gaps that could pinch or entrap objects such as fingers. While only one example of a pinch resistant contour is shown, it will be understood that other pinch resistant designs could be used in accordance with the concepts of the present invention. It will further be understood that sections 20 that do not have a pinch resistant design may be employed.

Figure 2:
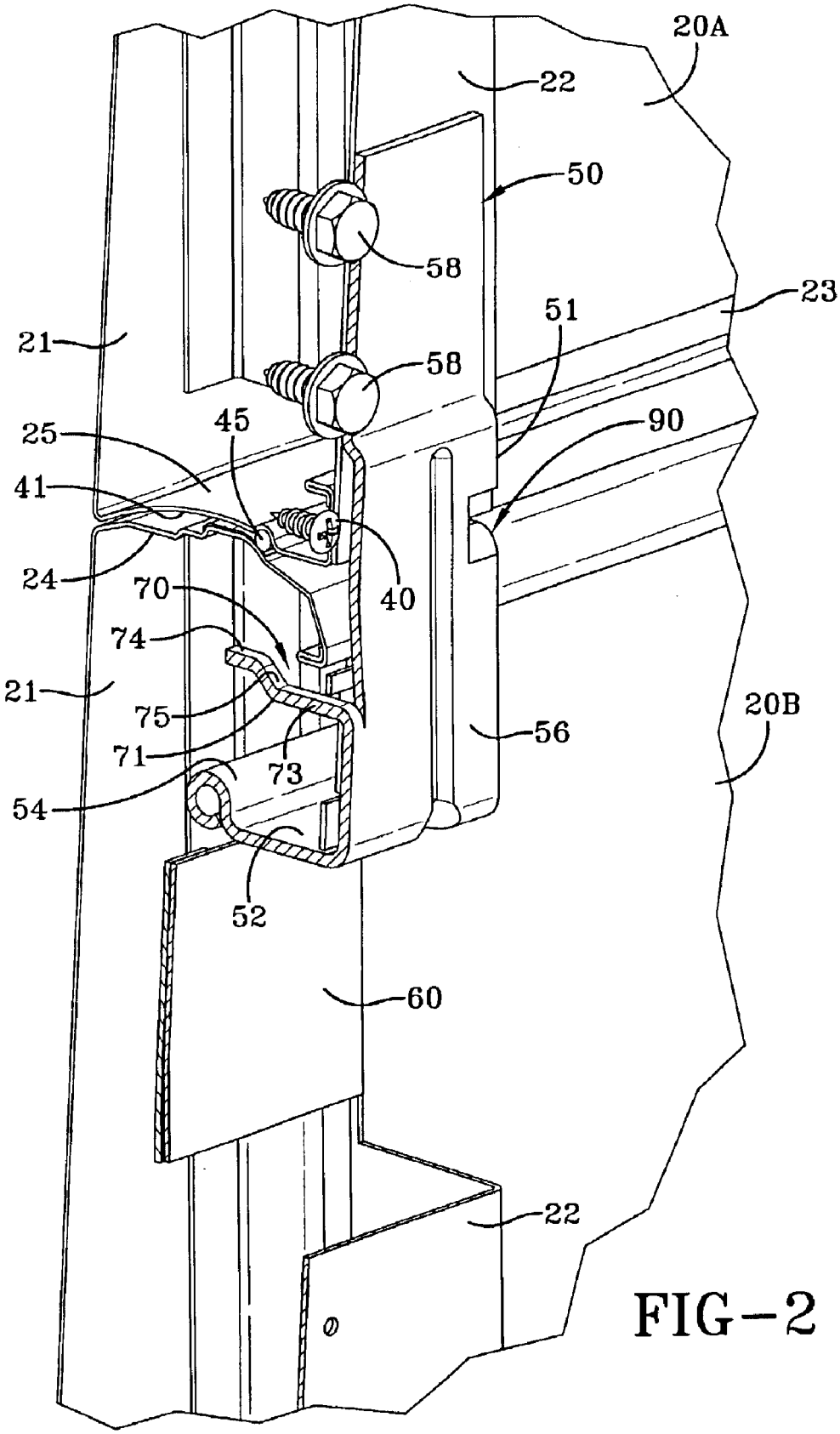
FIG. 2 an enlarged fragmentary rear perspective view with portions broken away and in section showing details of the hinge assembly according to the concepts of the present invention.
Figure 3:
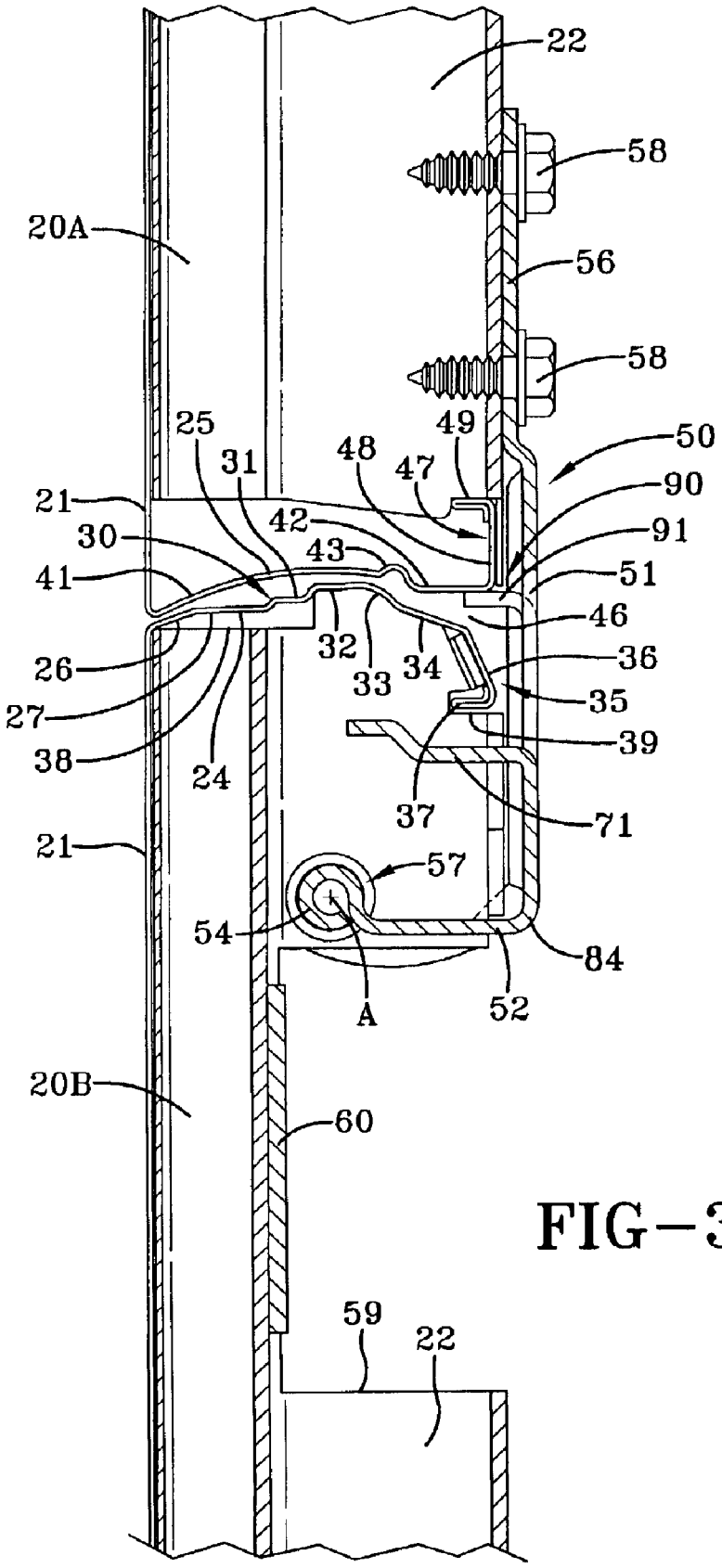
FIG. 3 is a sectional view taken substantially vertically through the area of the hinge assembly seen in FIGS. 2 depicting further details of the hinge assembly.
Figure 9:
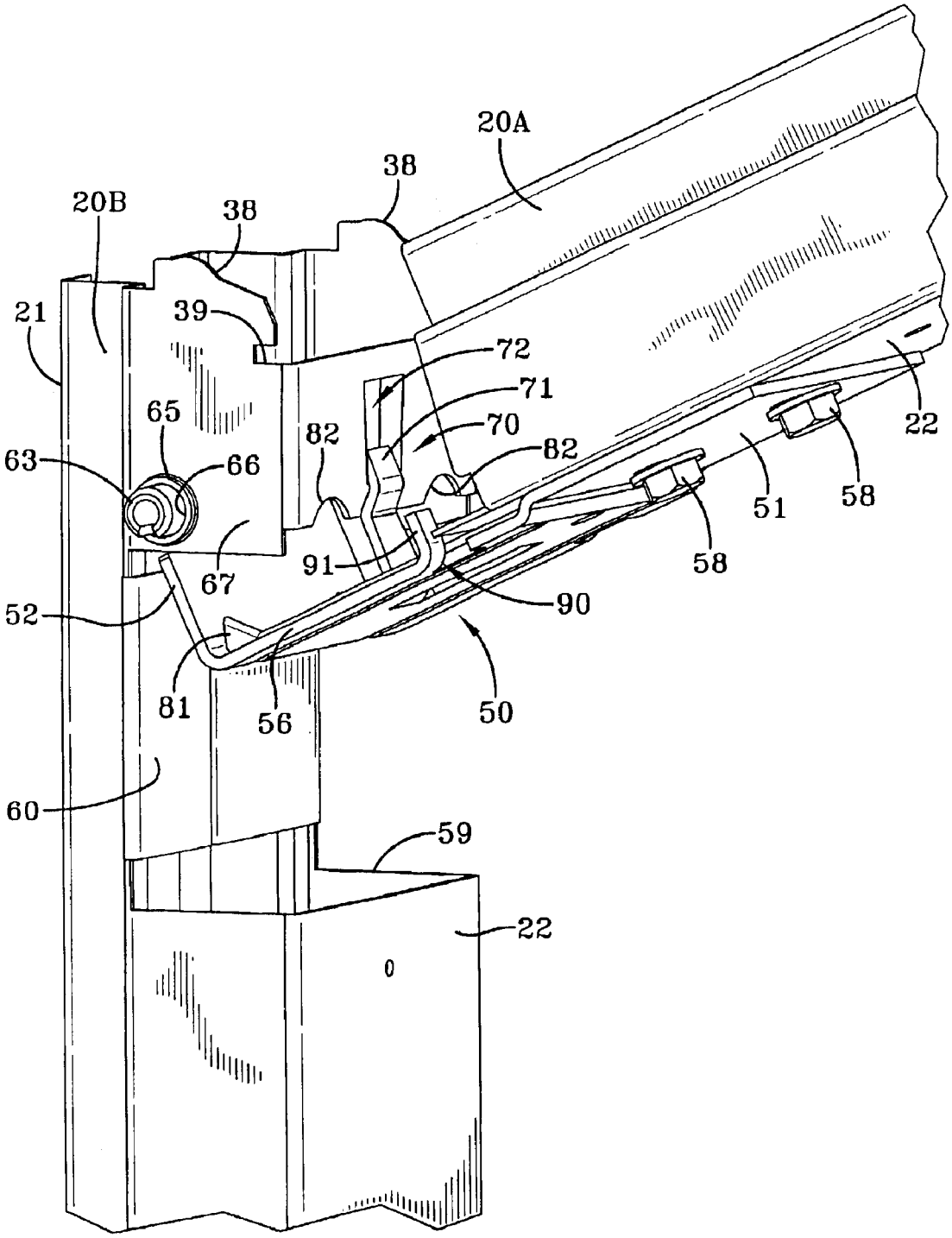
FIG. 9 is a rear fragmentary perspective view similar to FIG. 8 showing the hinge fully installed on adjacent sections and depicting entrance of a tab on the hinge into an aligning slot formed on a stile.

In the example shown in FIG. 3, upper flange 24 has an upwardly sloping leading face 26 extending rearwardly and upwardly from panel 21 to a generally horizontally extending portion 27. A raised portion, generally indicated by the numeral 30, which extends upward relative to the plane of the horizontal portion 27, is designed to fill any gap created by relative movement of adjacent sections 20A, 20B. While the raised portion 30 may be of any shape suitable for filling the aforementioned gap, in the embodiment shown raised portion 30 is stepped and includes a first tier 31 and a second tier 32 that are progressively elevated relative to the horizontal portion 27. The rear surface 33 of second tier 32 extends rearward and downward from the second tier 32 toward a downwardly sloping portion 34 of flange 24. The downwardly sloping portion 34 slopes downwardly and rearwardly relative to the plane of the horizontal portion 27 creating a clearance for the rotation of the superjacent section 20A. An upper hem, generally indicated at 35, may be formed on flange 24 to provide strength to the flange 24, and includes a downward extending face 36 and an inwardly extending edge 37. As shown in FIGS. 3 and 9, the upper extremity of stile 22 may be provided with a contoured edge 38 that generally conforms to the profile of upper flange 25 and includes a forwardly extending slot 39 in which the inwardly extending edge 37 may be received. Given the resilient nature of the flange 24, a spring fit may be achieved between the stile 22 and panel 21 by way of flange 24. Similar attachment may occur at the lower flange 25 or, as depicted in FIG. 2, fasteners 40 may be used to attach the lower flange 25 to the stile 22.

The lower flange 25 of section 20 may have an arcuate first section 41 that extends upwardly and rearwardly from panel 21 to create a clearance for relative rotation of the upper flange 24. As best shown in FIG. 3, first section 41 may have a generally constant radius relative to the pivot axis A of section 20A. First section 41 may extend rearwardly to a point above the second tier 32 of raised portion 30 near the start of the downward sloping rear surface 33 of second tier 32. A receiver 43 may be formed in flange 25 adjacent first section 41 and adapted to hold a sealing member 45, shown in FIG. 2. With reference to FIG. 3, a generally horizontal second section 42 may extend rearwardly from the receiver 43 at an elevation below the end of the first section 41 and at an elevation substantially equal to the highest point on top flange 24. Since second section 42 is located above the downwardly sloping portion 34 of top flange 24, when adjacent sections 20A, 20B are vertically oriented, as shown in FIG. 3, a clearance 46 is created between the flanges 24, 25 at this point.

As in the case of the upper flange 24, lower flange 25 may be provided with a lower hem, generally indicated by the numeral 47, that includes an upturned first curl portion 48, which may be generally vertical, and an inwardly extending second curl portion or edge 49. Edge 49 may be turned upon itself and extend generally horizontally toward the panel 21.

Adjacent sections 20A, 20B are pivotally joined by a hinge assembly, generally indicated by numeral 50, that may be attached to a stile 22. Hinge assembly includes a generally L-shaped hinge 51 having a first leg 52 that is pivotally coupled to the stile 22. To that end, the first leg 52 includes a curled end 54 or other member that rotates within pin receivers, generally indicated by the numeral 57, formed in the stile 22 to pivotally mount hinge 51. A second leg 56 of hinge 51 extends upwardly from the first leg 52 and may be formed generally perpendicular angle relative thereto. The second leg 56 spans the adjacent sections 20A, 20B, extending upwardly from first leg 52 over a portion of superjacent section 20A, where it is secured to stile 22 of superjacent section 20A, as by fasteners 58. In this way, superjacent section 20A is pivotally joined to subjacent section 20B by the hinge assembly 50 and rotates about the pivot axis A of hinge 51.

As best shown in FIG. 3, the axis A, about which the hinge 51 pivots, is located rearward of the panel 21 and, as shown may be located at an intermediate position relative to the rearward extension of the flanges 24, 25. In the example shown, axis A is located at a point substantially beneath the raised portion 30 of upper flange 24. With the pivot axis A located at an intermediate position to accommodate rotation of the first and second legs 52, 56, stile 22 may be provided with a hinge receiving cutout 59 located beneath the hinge assembly 50. As best shown in FIG. 9, cutout 59 provides a clearance for a portion of the hinge 51 as the superjacent panel 20A rotates relative to the subjacent panel 20B. A backing plate 60 may be provided on the stile 22 at the forward portion of cutout 59 and behind panel 21 to protect the panel 21 from any contact between the stile 22 and hinge 51.

Figure 4:
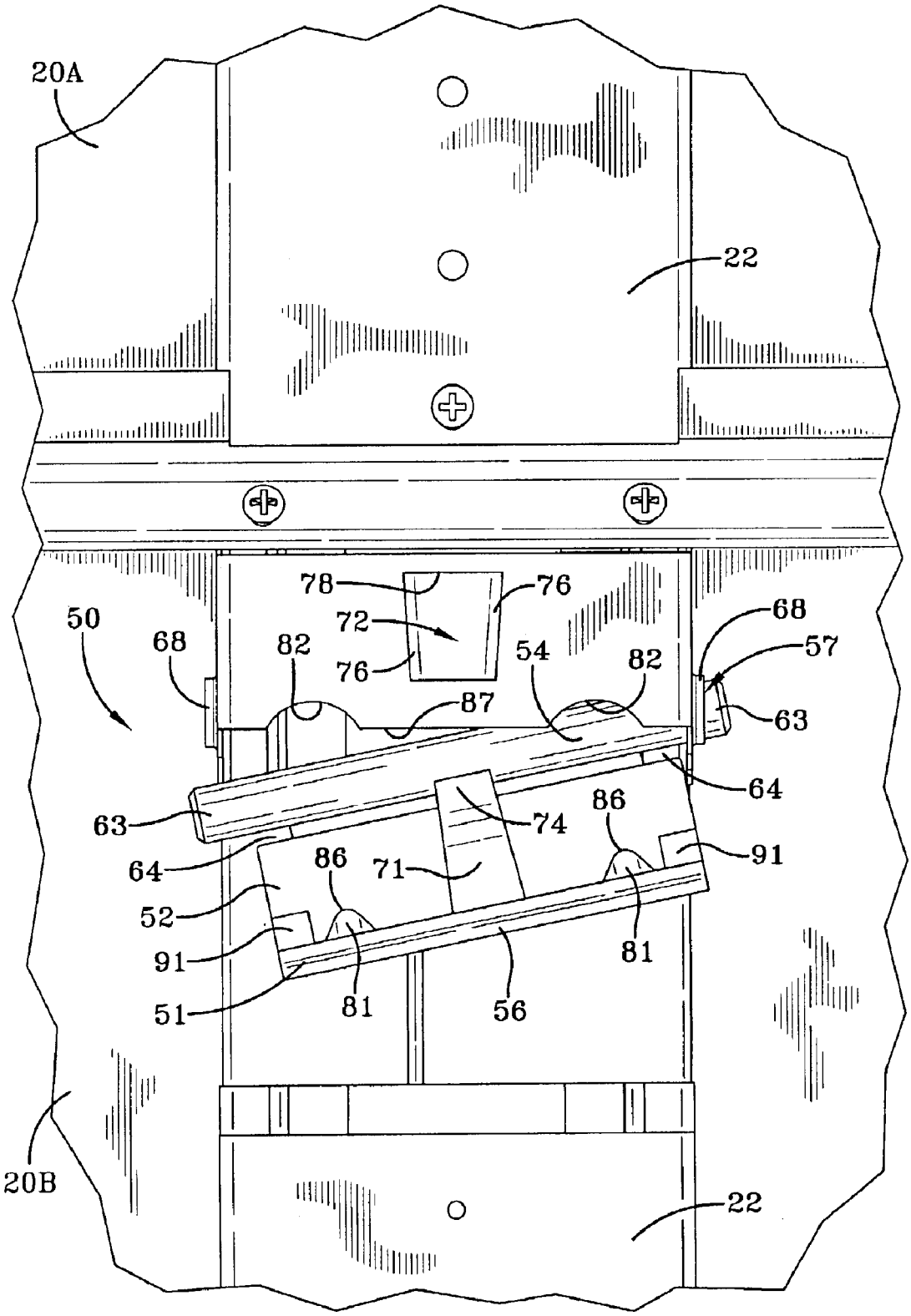
FIG. 4 is a rear elevational view of the area depicted in FIG. 2 showing details of an installation of a hinge assembly.

As will be appreciated by those of ordinary skill, some transverse movement of the sections 20 of door D may occur. Such movement may be permissible during portions of the operating range of the Door D, but in some instances may cause binding or otherwise damage the door components. To that end, the hinge assembly 50 is adapted to accommodate such movement along the pivot axis A, but limit such movement during selected portions of the door's operating range. Hinge assembly 50 accommodates movement along axis A by permitting the hinge 51 to travel along axis A. In the example shown, an extended pin bearing surface is provided, as by extending the effective length of a bore 66 in stile 22. As best seen in FIG. 4, the curled end 54 has a transverse length greater than the width of hinge 51 to permit movement of the hinge 51 along axis A. To extend the length of the bore 66, receiver 57 may include an annular flange 68 located concentrically of bore 66 and adjacent either sidewall 67 of stile 22. In the example shown in FIG. 4, flanges 68 are extruded axially outward from stile 22. The lateral outward extension of the flanges 68 provides an axially extended bearing surface for a pivot pin portion 63 of curled end 54.

Figure 7:
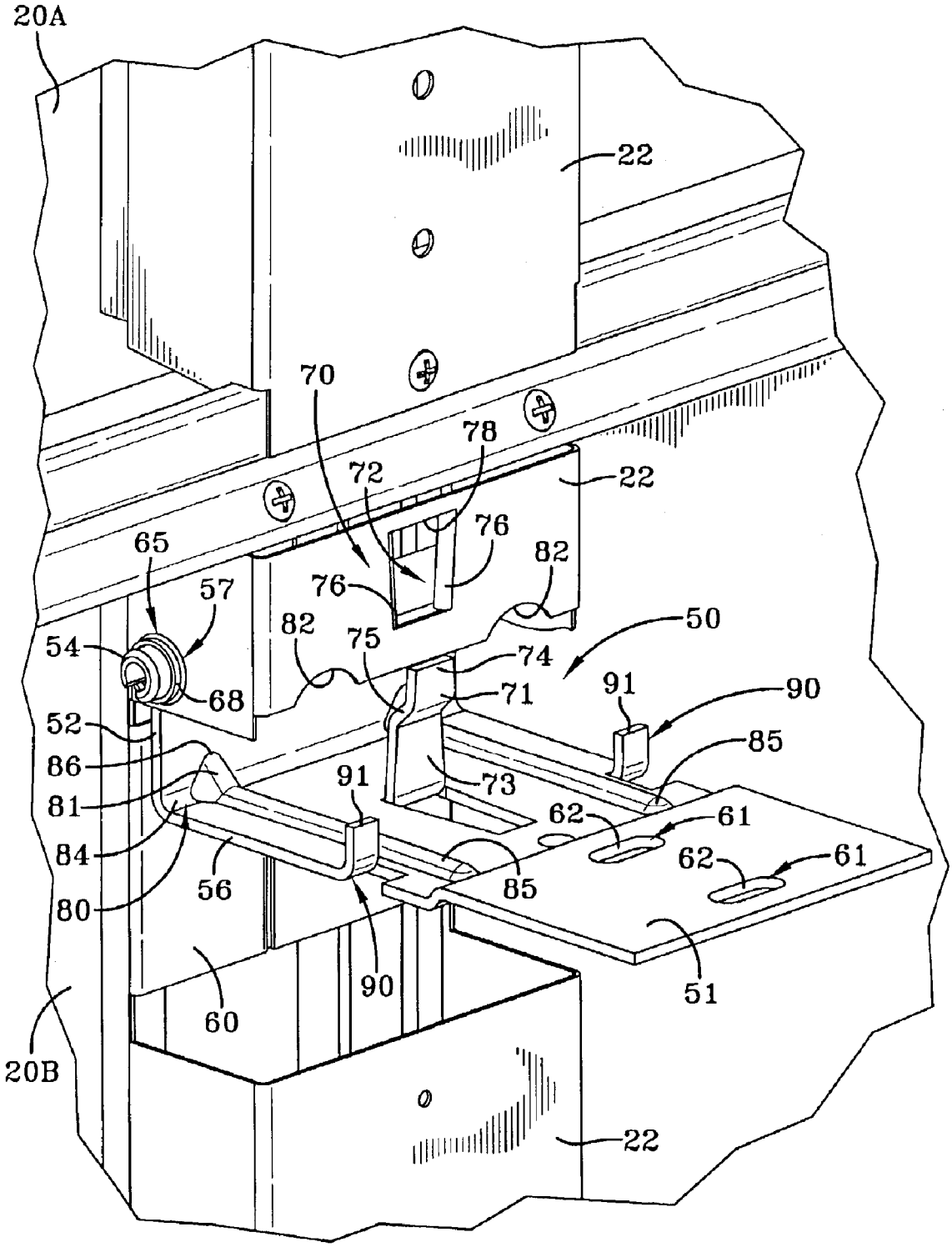
FIG. 7 is a rear fragmentary perspective view of the hinge depicted in FIG. 6 showing the hinge partially installed.

To adjust the position of the hinges 51 when the sections 20A and 20B are in the co-planar closed position, hinge 51 is provided with oversized openings, generally indicated by the numeral 61 (FIG. 7). By oversized, it is understood that opening 61 defines an opening larger than fasteners 58, such that hinge 51 is permitted to move relative to fasteners 58. In the example shown in FIG. 7, openings 61 define transversely extending slots 62. Slots 62 allow setting of the aligned position of the sections 20A and 20B when co-planar in the vertical closed position of door D.

Figure 8:
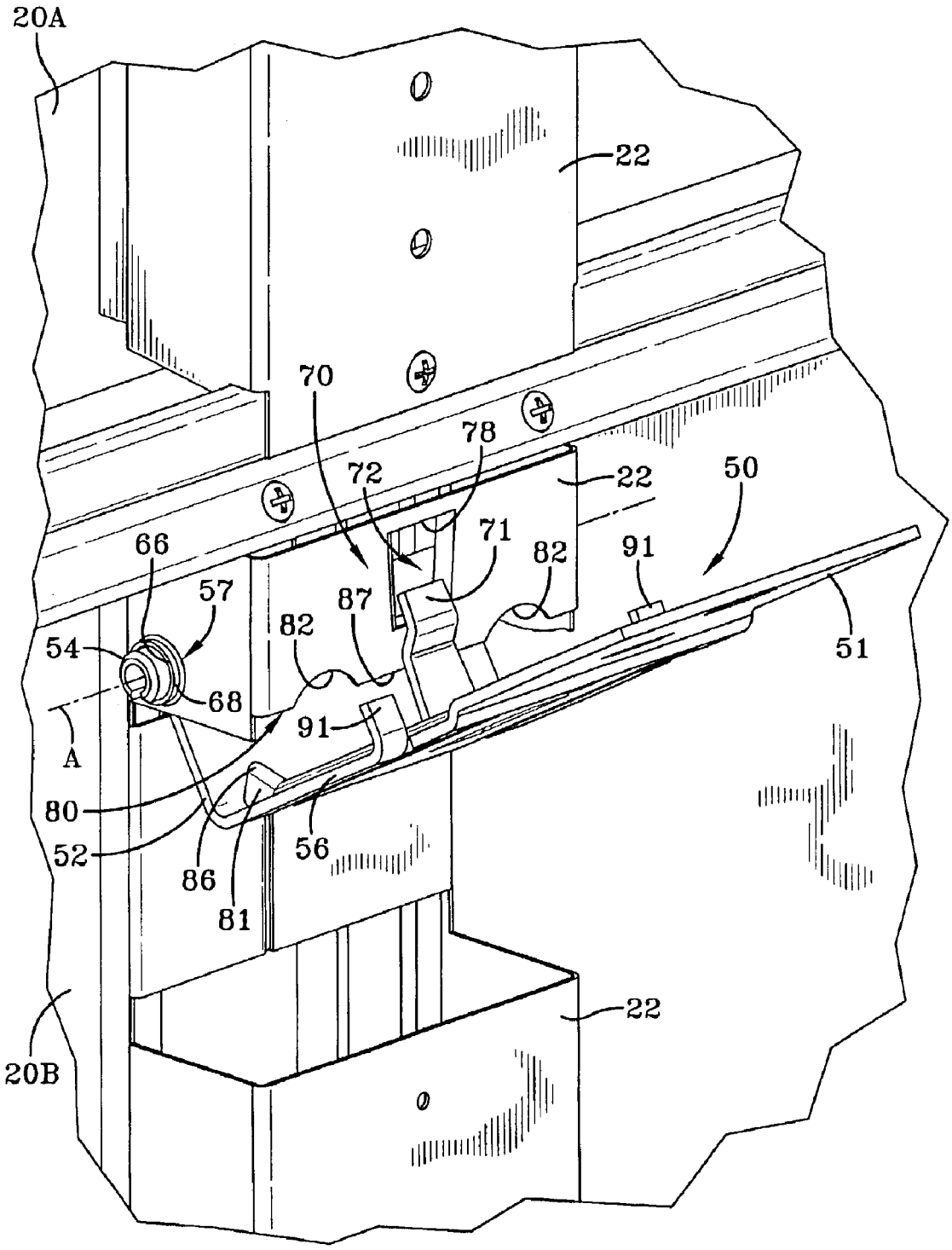
FIG. 8 is a rear fragmentary perspective view similar to FIG. 7 showing the hinge rotated upward into its operating range.

To prevent binding or other undesirable misalignment between sections 20A, 20B as the hinge 51 travels through the operating range of the door D and to assure alignment when closed, hinge assembly 50 includes a primary centering assembly, generally indicated by the numeral 70, and best understood by reference to FIGS. 7–9. Primary centering assembly 70 includes at least one tab member 71 that extends forwardly from the second leg 56 of hinge 51 to selectively interact with a tab receiver 72 to control movement of the hinge assembly 50. As will be appreciated, tab member 71 may have virtually any form or shape that is capable of positively contacting tab receiver 72 to variously restrict transverse movement of the hinge assembly 50. In the example shown in FIG. 7, tab member 71 may be contoured to facilitate its engagement with receiver 72 as adjacent panels 20A and 20B move relative to each other. To that end, tab member 71 has a substantially planar first portion 73 that extends forward from second leg 56 of hinge 51 along a single plane. A second portion 74 also extends inwardly relative to the second leg 56 of hinge 51 in generally a single plane, but is offset from the plane of the first portion 73 by a connecting portion 75. In the example shown, connecting portion 75 is upwardly sloped such, that the second portion 74 is elevated from the first portion 73. The offset between portions 73, 74 may be accomplished by any type of extension of connecting portion 75 including a vertical offset, curved offset, or linearly inclined extension.

Figure 5:
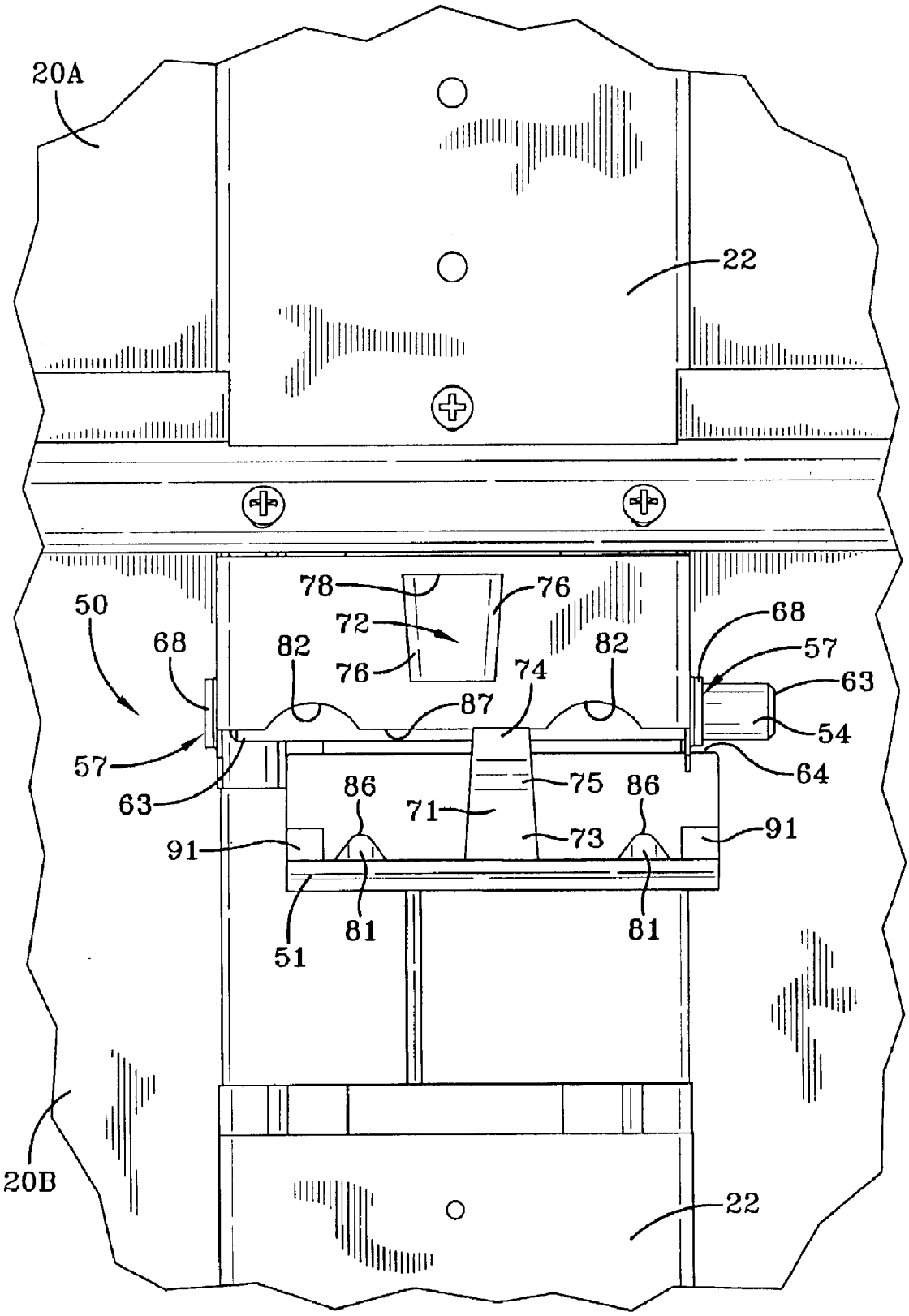
FIG. 5 is a rear elevational view similar to FIG. 4 showing details of a further step in the installation of the hinge assembly.

To control transverse movement in the hinge assembly 50, receiver 72 is provided with side walls 76 that are oriented generally in the plane of stile 22. The tab receiver 72 may be of generally any form that provides suitable positive contact with the tab member 71 to restrict movement of the hinge assembly 50 and thus section 20A relative to section 20B. In the example shown, side walls 76 form part of a cutout 78 formed in the stile 22. FIGS. 7–9 show an exemplary movement of the hinge assembly 50 through its normal operating range where, at a point of inclination between adjacent sections 20, as seen in FIG. 8, the tab member 71 enters cutout 78, such that its transverse movement is limited by the sidewalls 76 of the tab receiver 72. An exemplary operating range of sections 20 may be from planar alignment through an angle of approximately 60 degrees. To provide variable restriction of tab member 71's movement, the tab member 71 and/or receiver 72 may be designed to variably restrict relative axial movement during different phases of the door's movement. For example, as shown in FIGS. 7–8, the tab member 71 tapers inwardly as it extends forwardly from the second leg 56 of hinge 51. As best shown in FIG. 5, the tab member 71 may, for example, have a generally trapezoidal profile over its longitudinal length. Returning to FIGS. 7–9, as the tab member 71 enters the tab receiver 72, the narrow second portion 74 of tab member 71 is sized slightly smaller than the opening 78 of receiver 72, such that some transverse movement is permitted. As the sections progress toward a coplanar condition, as shown in FIG. 9, the tab member 71 is more deeply inserted causing an increasingly wider portion of the tab member 71 to enter tab receiver 72, such that the gap between the side walls 76 of receiver 72 and tab member 71 are gradually reduced. The reduction in clearance between the tab member 71 and tab receiver 72 increasingly restricts transverse movement of the hinge assembly 50 as the sections 20 progress toward the coplanar condition (FIG. 1). In this way, adjacent sections 20 are allowed to float relative to each other during each cycle within the limits of the relationship of the tab member 71 and tab receiver 72 to prevent binding caused by misalignment of manufactured components and consistently align the sections 20 at the time the door D is closed.

An alternative to primary centering assembly 70 or a secondary alignment device, generally indicated by the numeral 80, is one or more centering gussets 81 that are received within centering gusset receivers 82. In the example shown, a pair of gussets 81 may be spaced laterally outward from the tab member 71. Centering gussets 81 may extend forwardly from the hinge 51 proximate the juncture 84 of the first and second legs 52, 56 of hinge 51. As will be appreciated, in addition to performing the centering function described below, centering gussets 81 add strength to the hinge 51. As shown in FIG. 7, centering gussets 81 may include a bead portion that extends upwardly from the juncture 84 along the inner surface of second leg 56 to reinforce the hinge 51. It will be appreciated that centering gussets 81 may have any form that projects forwardly to engage gusset receivers 82, and may have a generally convex shape that is rounded or tapered toward a central peak 86 to facilitate their centering function. Gusset centering receivers 82 may be formed in a lower edge 87 of stile 22. The receivers shown are generally concave recesses formed in the lower edge 87 of stile 22 and may have a generally semicircular shape. As will be understood, by way of their corresponding convex and concave profiles, the engagement of centering gusset 81 and gusset receiver 82 tend to draw or deflect the centering gusset 81 to a central location within the receiver 82 and accordingly, align the hinge 51 and attached adjacent sections 20. As in the case of tab member 71, centering gussets 81 are flared outward at their bases to increasingly restrict lateral movement of the gussets 81 within gusset receivers 82 as the door approaches a vertical closed condition (FIG. 1).

As is best seen in FIG. 9, the centering gussets 81 may be used as a secondary aligning device in conjunction with stop assembly 70. The centering gussets 81 extend forwardly from the hinge 51 to a lesser extent than the tab member 71 and, thus, do not engage gusset receivers 82 until the sections 20 are closer to an aligned condition.

In accordance with another aspect of the present invention, a section spacing assembly, generally indicated by the numeral 90, is provided to ensure proper vertical positioning of adjacent sections 20A and 20B. Section spacing assembly 90 includes a spacing member 91 that extends forwardly from the second leg 56 of hinge 51 at a vertical position generally corresponding to the clearance 46 formed between adjacent sections 20A, 20B. As best shown in FIG. 3, when the sections 20 are vertically aligned, the spacing member 91 resides within clearance 46 and in supporting contact with the lower flange 25 of the superjacent section 20A. In this way, the spacing member 91 sets the proper spacing between adjacent panels 20 to prevent the sections 20 from rubbing against each other at their interface, particularly when proximate the vertical closed position of FIG. 2. It will be appreciated that the spacing member 91 may have a variety of shapes including a projecting tab like member as shown.

With reference to FIGS. 7–9, in operation, as the sections 20 move along the tracks 15, adjacent sections 20A, 20B pivot relative to each other about axis A. As the sections 20 pass through the arcuate transition portion 18 of tracks 15, adjacent sections 20A, 20B and accordingly the hinge assembly 50 become angularly disposed relative to each other (FIGS. 8 and 9). Within this range of the section's movement, the tab member 71 is at least partially withdrawn from the tab receiver 72 allowing some transverse movement between adjacent sections 20A, 20B. As the sections 20 return to an aligned condition, i.e., when the sections 20 are in a common plane, such as when in the vertical closed condition or horizontal open condition, the angle between adjacent sections gradually decreases causing the tab member 71 to be progressively inserted into the stop receiver 72. Contact of the tab member 71 with tab receiver 72 urges the sections 20 toward transverse alignment relative to each other. As noted above, the tab member 71 may be tapered causing the clearance between the tab receiver 72 and tab member 71 to progressively decrease as the panels approach a coplanar condition. To further promote alignment of the sections 20, secondary alignment devices, such as centering gussets 81, draw the adjacent sections 20A, 20B toward an aligned position on axis A.

In accordance with another feature of the present invention, as the sections 20 become coplanar, the spacing member 91 is insertably received between adjacent sections 20A, 20B in supporting relation to a superjacent section 20A to ensure consistent proper vertical spacing of the adjacent sections 20A, 20B. By setting the proper spacing, spacing assembly 90 prevents rubbing or binding between the flanges 24, 25 at the interface.

Figure 6:
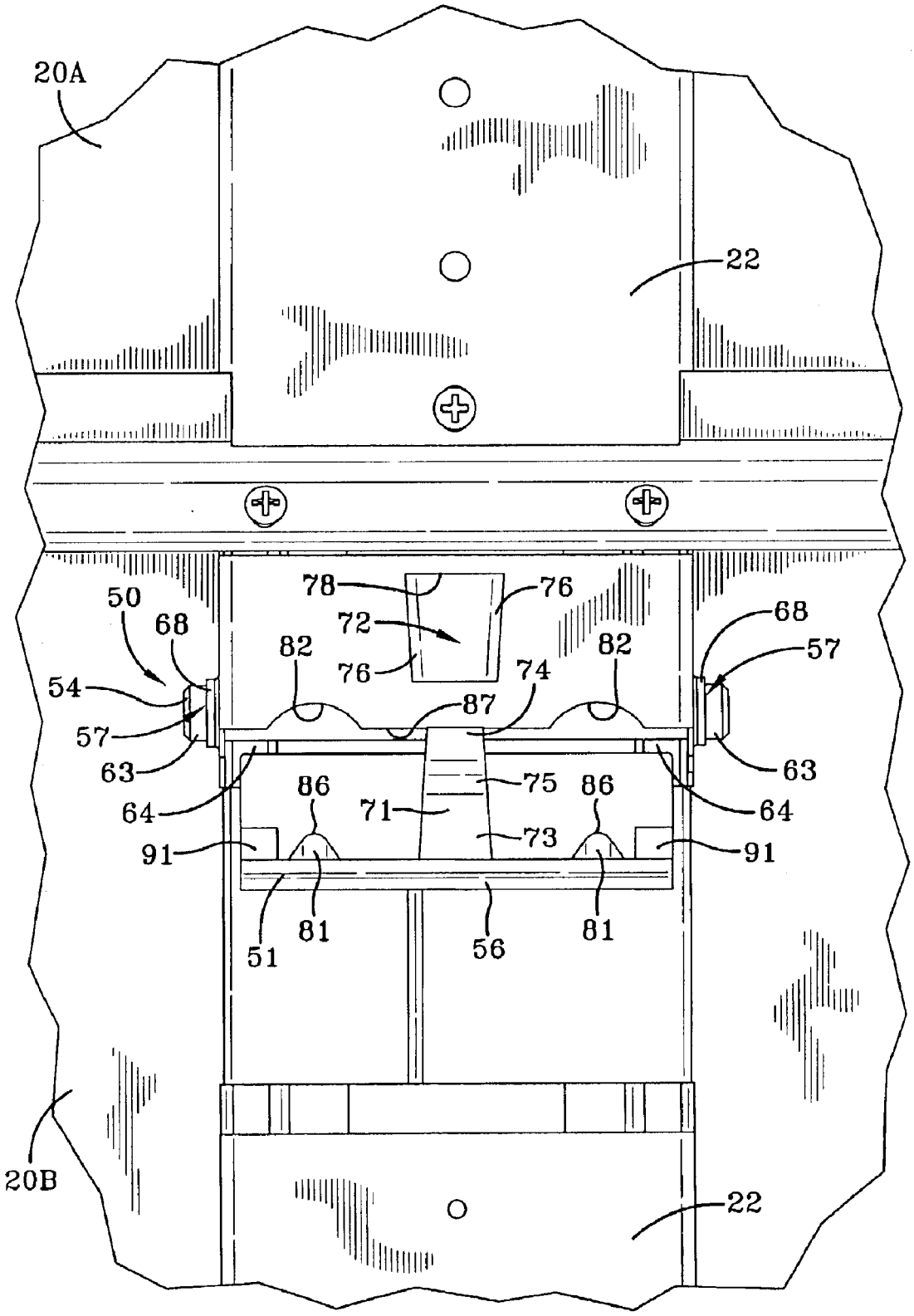
FIG. 6 is a rear elevational view similar to FIG. 5 showing a still further step in details of the installation of the hinge assembly.

Installation of an exemplary hinge assembly 50 will now be described with reference to FIGS. 4–6. With the sections 20 vertically stacked in the closed condition, as is typical during the installation of a door D, the hinge 51 is oriented such that the second leg 56 extends essentially horizontally rearward of the door D. To insert the curled end 54 of first leg 52 into receiver 57, the hinge 51 is tilted or canted about an axis normal to the plane of a section 20, as shown in FIG. 4. In this way, pivot portion 63 of curled end 54 may be inserted through the receiver 57 beyond flange 68. To facilitate overinsertion of pivot portion 63 at one end of curled end 54, relief recesses 64 may be formed in the first leg 52 adjacent to the curled end 54. As best shown in FIG. 5, these relief recesses 64 allow pivot portion 63 of the curled end 54 to be overinserted at one receiver 57, such that the opposite pivot portion 63 of curled end 54 fits within the confines of the side walls 67 of stile 22. In this way, as depicted in FIG. 5, the hinge 51 may be returned to a generally horizontal configuration with the curled end 54 aligned along the axis A in readiness for insertion of both pivot portions 63 in their respective receivers 57 (FIG. 6). In FIG. 6, the curled end 54 is shown with both pivot portions 63 extending through receivers 57 formed in the stile 22 and beyond the flanges 68 that extend outwardly from the stile 22. In this position, the hinge 51 is pivotally supported in the subjacent section 20B. To complete installation, the hinge 51 is rotated upwardly as depicted in FIG. 8, such that the tab member 71, centering gusset 81 and spacing member 91 are fully engaged, when the second leg 56 extends parallel to the plane of the aligned sections 20A, 20B (FIG. 3). At this point, fasteners 58 may be driven through opening 61 formed in the second leg 56 into the superjacent panel 20A to secure the hinge 51. As discussed previously, the centering assembly 70 and spacing assembly 90 ensure proper spacing and alignment of the sections 20, such that the door D is properly aligned and ready for operation when the hinge assemblies 50 are attached.

Thus, it should be evident that the aligning of the sections of a sectional door by the hinge design disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A door system comprising, a plurality of sections pivotally joined to each other by a hinge assembly, said hinge assembly being pivotally supported by and transversely movable relative to one of said sections, a leg of said hinge assembly that extends from said one of said sections and is attached to an adjacent of said sections, and a centering assembly including a tab member extending from one of said leg and said one of said sections toward a tab receiver carried on the other of said leg and said one of said sections, whereby interaction of said tab member and said tab receiver ensures transverse alignment of said sections when said sections are in planar alignment.

2. The door system of claim 1, wherein said tab member tapers transversely inwardly as said tab member extends from said leg toward said tab receiver.

3. The door system of claim 1, wherein said tab member is formed integral with said leg of said hinge.

4. The door system of claim 1, wherein said tab receiver is a cutout formed in a portion of said one of said sections.

5. The door system of claim 4, wherein said portion of said one of said sections where said cutout is formed is a stile.

6. The door system of claim 5, wherein said stile pivotally and transversely movably supports said hinge assembly.

7. The door system of claim 6, wherein said hinge assembly is pivotally attached to said stile at an intermediate position relative to the front and rear of said one of said sections.

8. The door system of claim 5, wherein said hinge assembly has a pivot pin and said stile has pivot pin receivers, whereby said pivot pin is insertable in said pivot pin receivers.

9. The door system of claim 8, wherein said pivot pin is axially movable in said pivot pin receivers.

10. The door system of claim 1 further comprising, a spacing assembly including a spacing member extending forwardly from said leg of said hinge, said spacing member being insertably received between said sections as said sections become aligned in a common plane, whereby said spacing member engages at least one of said sections to provide a selected vertical spacing of said sections.

11. The door system of claim 10, wherein said spacing member is a projecting tab.

12. The door system of claim 1, wherein said leg of said hinge assembly includes openings adapted to receive fasteners permitting relative transverse adjustment between said hinge and said adjacent of said sections when said sections are in planar alignment.

13. The door system of claim 12, wherein said openings are transverse slots in said leg.

14. The door system of claim 1, wherein said hinge assembly is mounted on a stile on said one of said sections and said stile includes a pair of spaced axially aligned receiver bores adapted to rotatably and axially movably support a pivot pin on said hinge assembly.

15. The door system of claim 14, wherein said leg is attached to an adjacent of said sections at a stile attached thereto.

16. A door system comprising, a plurality of sections pivotally joined to each other by a hinge assembly, said hinge assembly being pivotally supported on one of said sections and having a leg that extends from said one of said sections and is attached to an adjacent of said sections, and a centering assembly including a tab member extending forwardly from said leg toward a tab receiver carried on said one of said sections, whereby interaction of said tab member and said tab receiver ensures alignment of said sections when said sections are in planar alignment, said tab member having a first portion extending from said leg and a second portion extending from said first portion and vertically offset therefrom, whereby said first portion and said second portion are not coplanar.

17. The door system of claim 16, wherein an inclined connecting portion joins said first and second portions of said tab member.

18. The door system of claim 17, wherein said connecting portion extends upwardly and forwardly from said first portion of said tab member.

19. A door system comprising, a plurality of sections pivotally joined to each other by a hinge assembly, said hinge assembly being pivotally supported on one of said sections and having a leg that extends from said one of said sections and attached to an adjacent of said sections, a centering assembly including a tab member extending forwardly from said leg toward a tab receiver carried on said one of said sections, whereby interaction of said tab member and said tab receiver ensures alignment of said sections when said sections are in planar alignment, at least one centering gusset extending forwardly from said leg of said hinge and tapering from said leg toward a peak, and a centering gusset receiver having a profile adapted to interact with said centering gusset to urge said peak toward a selected position.

20. The door system of claim 19, wherein said profile is semicircular.

21. A door system comprising: a plurality of sections pivotally joined and transversely relatively movable by a hinge assembly; said hinge assembly being rotatably supported on one of said sections and attached to an adjacent of said sections; said hinge being rotatable on an axis; alignment means carried on said hinge assembly and said one of said sections urging said sections axially along said axis into transverse alignment with each other during a selected portion of an operating range of the door, while permitting controlled movement relative to each other along said axis during other portions of said operating range.

22. The door system of claims 21 further comprising, spacing means carried on said hinge and adapted to engage at least one of said sections when said sections are in a selected position to urge said sections into selected vertical spacing relative to each other.

23. The door system of claim 21, wherein said alignment means has a tab member on said hinge for operatively engaging a tab receiver on said one of said sections.

24. The door system of claim 23, wherein said alignment means has a centering gusset on said hinge for operatively engaging a centering gusset receiver on said one of said sections.

25. A method of assembling a sectional door comprising the steps of providing a plurality of sections each having at least one stile with a pair of transversely aligned receivers, arranging said sections in stacked adjacent co-planar relationship, positioning a single leaf hinge having spaced pivot portions in canted relation to said stile, inserting one of said pivot portions of said hinge in one of said receivers, aligning said hinge with said stile, inserting the other of said pivot portions of said hinge in the other of said receivers in said stile to pivotally mount said hinge relative to said stile, aligning said hinge axially of said pivot portions relative to said stile, and attaching said hinge to an adjacent of said sections.

26. The method of assembling a sectional door according claim 25, wherein said step of aligning said hinge includes employing a centering tab on either of said hinge and said stile and employing a tab receiver on the other of said hinge and said stile, said centering tab and said tab receiver engaging to effect transverse relative alignment of said sections.

27. The method of assembling a sectional door according claim 25 further comprising the step of employing a spacing assembly on said hinge to effect relative vertical positioning of said sections when in the stacked planar position.

28. A door system comprising, a plurality of sections pivotally joined to each other by a hinge assembly, said hinge assembly being pivotally supported by and transversely movable relative to one of said sections, a leg of said hinge assembly that extends from said one of said sections and is attached to an adjacent of said sections, and a centering assembly including a centering gusset member extending from one of said leg and one of said sections toward a centering gusset receiver carried on the other of said leg and said one of said sections, whereby interaction of said centering gusset and said centering gusset receiver ensures transverse alignment of said sections when said sections are in planar alignment.

29. The door system of claim 28, wherein said centering gusset tapers to a peak and said centering gusset receiver has a profile adapted to interact with said centering gusset to urge said peak toward a selected position.

30. The door system of claim 29, wherein said profile of said centering gusset receiver is a concave recess.

* * * * *